US011337580B2

(12) United States Patent
Törnquist

(10) Patent No.: US 11,337,580 B2
(45) Date of Patent: May 24, 2022

(54) METHOD FOR CONTROLLING OPERATION OF A HOUSEHOLD APPLIANCE AND A HOUSEHOLD APPLIANCE

(71) Applicant: ELECTROLUX APPLIANCES AKTIEBOLAG, Stockholm (SE)

(72) Inventor: Vendela Törnquist, Stockholm (SE)

(73) Assignee: Electrolux Appliances Aktiebolag

( * ) Notice: Subject to any disclaimer, the term of this patent is extended or adjusted under 35 U.S.C. 154(b) by 171 days.

(21) Appl. No.: 16/500,873

(22) PCT Filed: Apr. 28, 2017

(86) PCT No.: PCT/EP2017/060209

§ 371 (c)(1),
(2) Date: Oct. 4, 2019

(87) PCT Pub. No.: WO2018/197000

PCT Pub. Date: Nov. 1, 2018

(65) Prior Publication Data

US 2020/0029778 A1 Jan. 30, 2020

(51) Int. Cl.
*A47L 15/00* (2006.01)
*A47L 15/42* (2006.01)

(52) U.S. Cl.
CPC ..... *A47L 15/0049* (2013.01); *A47L 15/0023* (2013.01); *A47L 15/4225* (2013.01);
(Continued)

(58) Field of Classification Search
CPC ..... A47L 15/0023; A47L 15/0049; A47L 15/4225; A47L 15/4244; A47L 15/4285;
(Continued)

(56) References Cited

U.S. PATENT DOCUMENTS 5,364,051 A * 11/1994 Philpot ..... A47L 15/4285 248/229.26
8,480,811 B2 7/2013 King
(Continued)

FOREIGN PATENT DOCUMENTS

EP 1 647 220 A2 4/2006
FR 2 558 713 A1 8/1985
(Continued)

OTHER PUBLICATIONS

International Search Report and Written Opinion for Application No. PCT/EP2017/060209 dated Jan. 3, 2018, 10 pages.

*Primary Examiner* — David G Cormier
(74) *Attorney, Agent, or Firm* — RatnerPrestia

(57) ABSTRACT

A method for controlling operation of a household appliance may include supplying a liquid to a first space, determining a first behavior(TB1) of temperature measured by a first temperature sensor during supplying of the liquid to the first space, supplying the liquid to a second space by activating a pump in order to transport the liquid from the first space to the second space, determining a second behavior (TB2) of temperature measured by a second temperature sensor during supplying of the liquid to the second space, and determining if a sufficient amount of the liquid has been supplied to the second space or not based on the second behavior (TB2) evaluated with respect to the first behavior (TB1). A household appliance may also be provided.

6 Claims, 3 Drawing Sheets

(52) U.S. Cl.
CPC ..... *A47L 15/4285* (2013.01); *A47L 15/4287* (2013.01); *A47L 15/0042* (2013.01); *A47L 2401/12* (2013.01); *A47L 2401/18* (2013.01); *A47L 2501/26* (2013.01)

(58) Field of Classification Search
CPC ..... A47L 15/4287; A47L 15/4297; A47L 2401/06; A47L 2401/08; A47L 2401/09; A47L 2401/12
See application file for complete search history.

(56) References Cited

U.S. PATENT DOCUMENTS

2004/0255977 A1 12/2004 Slocum et al.
2006/0081272 A1* 4/2006 Jung ..... A47L 15/0049 134/18

FOREIGN PATENT DOCUMENTS

JP 2 942420 B2 8/1999
JP 3 385706 B2 3/2003

* cited by examiner

METHOD FOR CONTROLLING OPERATION OF A HOUSEHOLD APPLIANCE AND A HOUSEHOLD APPLIANCE

CROSS-REFERENCE TO RELATED APPLICATIONS

This application is a national stage application filed under 35 U.S.C. § 371 of International Application No. PCT/EP2017/060209 filed Apr. 28, 2017 and published as WO2018197000, which application is hereby incorporated by reference herein in its entirety.

TECHNICAL FIELD

Embodiments herein relate to a method for controlling operation of a household appliance and to a household appliance.

BACKGROUND

Water heating elements in household appliances, as for example dishwashers or washing machines, are used to heat water to some desired temperature suitable for use in the household appliance. Water is required, for example for washing of dishes and also for lubricating of seals in a dishwasher to prevent seal damage from excessive heat generated by running dry. Running dry or with not sufficient amount of water may cause damage of the heating element.

According to some conventional methods for determining presence of water in a dishwasher a flow meter or a pressure sensor is used. Such elements increase the total cost of the dishwasher and require a flow of water to enable operation of the elements.

U.S. Pat. No. 8,480,811 describes a method for detecting presence of water in a sump of a dishwasher by monitoring changes in temperature of the water in the sump. A change in temperature of the water in the sump is compared with a predetermined temperature change. After this comparison it is determined if a sufficient level of water is present in the sump.

However, the known methods as above are not very accurate and reliable for preventing a household appliance running dry.

SUMMARY

An object of the embodiments herein is to provide an improved method for controlling operation of a household appliance.

According to an aspect, a method is provided for controlling operation of a household appliance which comprises a first space, a second space, and a pump arranged to transport a liquid from the first space to the second space. The household appliance further comprises a heating element arranged to heat the liquid in the second space, a first temperature sensor arranged within the first space, and a second temperature sensor arranged at the heating element.

Thus, the first temperature sensor may be used for detecting and monitoring temperature changes in the first space. The temperature changes measured by the first temperature sensor may be caused by a liquid supplied to the first space.

The heating element is arranged to heat the liquid in the second space. With other words, the heating element is arranged to enable transfer of heat energy from the heating element to a liquid supplied to the second space. Because the second temperature sensor is arranged at the heating element the second temperature sensor may register, i.e. measure temperature changes of the heating element during heating of the liquid in the second space. The second temperature sensor may also register temperature changes at the heating element caused by the liquid supplied to the second space. This because the heating element is arranged so that a transfer of thermal energy between the heating element and the liquid in the second space is possible. The heating element may be arranged to have direct contact with the liquid supplied to the second space.

In this method, the liquid is supplied to the first space and a first behavior of temperature, as measured by the first temperature sensor during supplying of the liquid to the first space, is determined.

The first behavior, which may also be called first characteristic of the measured temperature by first temperature sensor, describes how the temperature changes during suppling of the liquid to the first space.

The first behavior is obtained by measuring values of the temperature registered by the first temperature sensor which measured values of the temperature may be illustrated as a plot or a chart, for example a line chart.

The liquid is then supplied to the second space by activating the pump in order to transport the liquid from the first space to the second space. A second behavior of temperature, as measured by the second temperature sensor during supplying of the liquid to the second space, is further determined.

The second behavior, which may also be called second characteristic of the measured temperature by second temperature sensor, describes how the temperature changes during suppling of the liquid to the second space.

The second behavior is obtained by measuring values of the temperature registered by the second temperature sensor which measured values of the temperature may be illustrated as a plot or a chart, for example a line chart.

It is then determined if a sufficient amount of the liquid has been supplied to the second space or not based on the second behavior evaluated with respect to the first behavior. With other words, the second behavior is compared with the first behavior in order to determinate if the sufficient amount of the liquid has been supplied to the second space or not.

Different amounts of liquid supplied to the second space will cause different behaviors of temperature measured by the second temperature sensor. If no liquid is supplied to the second space the second behavior will simply show no temperature change because the second temperature sensor will register substantially the same temperature in the second space. Thus, the sufficient amount of the liquid supplied to the second space will cause a certain second behavior depending on the first behavior.

Therefore, by comparing the second behavior with the first behavior it may be determined if the sufficient amount of the liquid has been supplied to the second space or not in a simple and reliable manner.

Consequently, by the method it may be determined if the sufficient amount of the liquid has been supplied to the second space or not. Thus, running dry, i.e. turning on the heating element in order to heat the liquid in the second space when not sufficient amount of the liquid has been supplied may be prevent. Further, function of the pump may be diagnosed, i.e. it may be determined if the pump works properly or not.

Thereby, an improved method for controlling operation of a household appliance is achieved.

As a result, the above mentioned object can be achieved.

According to an example embodiment, the method may further comprise determining a maximum change in temperature during supplying of the liquid to the first space by evaluating the first behavior, and determining a change in temperature during supplying of the liquid to the second space by evaluating of the second behavior. In this embodiment, the determining if the sufficient amount of the liquid has been supplied to the second space or not may be based on a comparison of the change in temperature and the maximum change in temperature. Thereby, the second behavior may be compared with the first behavior in a simple way.

When the latter embodiment is used, another example embodiment may be that the method further comprises indicating that the sufficient amount of the liquid has been supplied to the second space if the change in temperature is at least a half of the maximum change in temperature.

As an alternative embodiment, the method may further comprise indicating that the sufficient amount of the liquid has not been supplied to the second space if the change in temperature is less than a half of the maximum change in temperature.

According to another example embodiment, the sufficient amount of the liquid may be required for a safe operation of the household appliance. With other words, the sufficient amount of the liquid is an amount that is needed during operation of the household appliance to prevent damage of the heating element or other components in the household appliance.

According to another example embodiment, the second temperature sensor may be arranged at a surface of the heating element. Thereby, installation i.e. mounting of the second temperature sensor at the heating element is facilitated. Further, by the second temperature sensor arranged at the surface of the heating element measurement of temperature changes of or at the heating element is improved.

Another object of the embodiments herein is to provide an improved household appliance configured to perform the improved method for controlling operation of the household appliance. The method has been described above.

According to another aspect a household appliance is provided which comprises a first space, a second space, a pump arranged to transport a liquid from the first space to the second space, a heating element arranged to heat the liquid in the second space, a first temperature sensor arranged within the first space, and a second temperature sensor arranged at the heating element.

The household appliance also comprises a control unit being configured to control operation of the household appliance to accomplish one or more of the above-mentioned embodiments.

The household appliance is configured to supply the liquid to the first space, and to determine a first behavior of temperature measured by the first temperature sensor during supplying of the liquid to the first space. The household appliance is further configured to supply the liquid to the second space by activating the pump in order to transport the liquid from the first space to the second space, and to determine a second behavior of temperature measured by the second temperature sensor during supplying of the liquid to the second space. The household appliance is also configured to determine if a sufficient amount of the liquid has been supplied to the second space or not based on the second behavior evaluated with respect to the first behavior.

By comparing the second behavior with the first behavior it may be determined if the sufficient amount of the liquid has been supplied to the second space or not. Thus, running dry, i.e. turning on the heating element in order to heat the liquid in the second space when not sufficient amount of the liquid has been supplied may be prevent. Further, the function of the pump may be diagnosed, i.e. it may be determined if the pump works properly or not.

Thereby, an improved household appliance is achieved.

As a result, the above mentioned object can be achieved.

The household appliance may be further configured to determine a maximum change in temperature during supplying of the liquid to the first space by evaluating the first behavior, and to determine a change in temperature during supplying of the liquid to the second space by evaluating of the second behavior. In this embodiment, the determining if the sufficient amount of the liquid has been supplied to the second space or not may be based on a comparison of the change in temperature and the maximum change in temperature.

The household appliance may be further configured to indicate that the sufficient amount of the liquid has been supplied to the second space if the change in temperature is at least a half of the maximum change in temperature. Alternatively, the household appliance may be configured to indicate that the sufficient amount of the liquid has not been supplied to the second space if the change in temperature is less than a half of the maximum change in temperature.

As mentioned above, the sufficient amount of the liquid may be required for a safe operation of the household appliance. Also, the second temperature sensor may be arranged at a surface of the heating element.

Further features and advantages of the embodiments herein will become apparent when studying the appended claims and the following detailed description. Those skilled in the art will realize that the different features described may be combined to create embodiments other than those described in the following, without departing from the scope defined by the appended claims.

BRIEF DESCRIPTION OF THE DRAWINGS

The various aspects mentioned above, including their particular features and advantages, will be readily understood from the following detailed description and the accompanying drawings, in which.

DETAILED DESCRIPTION

The embodiments herein will now be described in more detail with reference to the accompanying drawings, in which example embodiments are shown. Disclosed features of example embodiments may be combined. Like numbers refer to like elements throughout. Well-known functions or constructions will not necessarily be described in detail for brevity and/or clarity.

Figure 1:
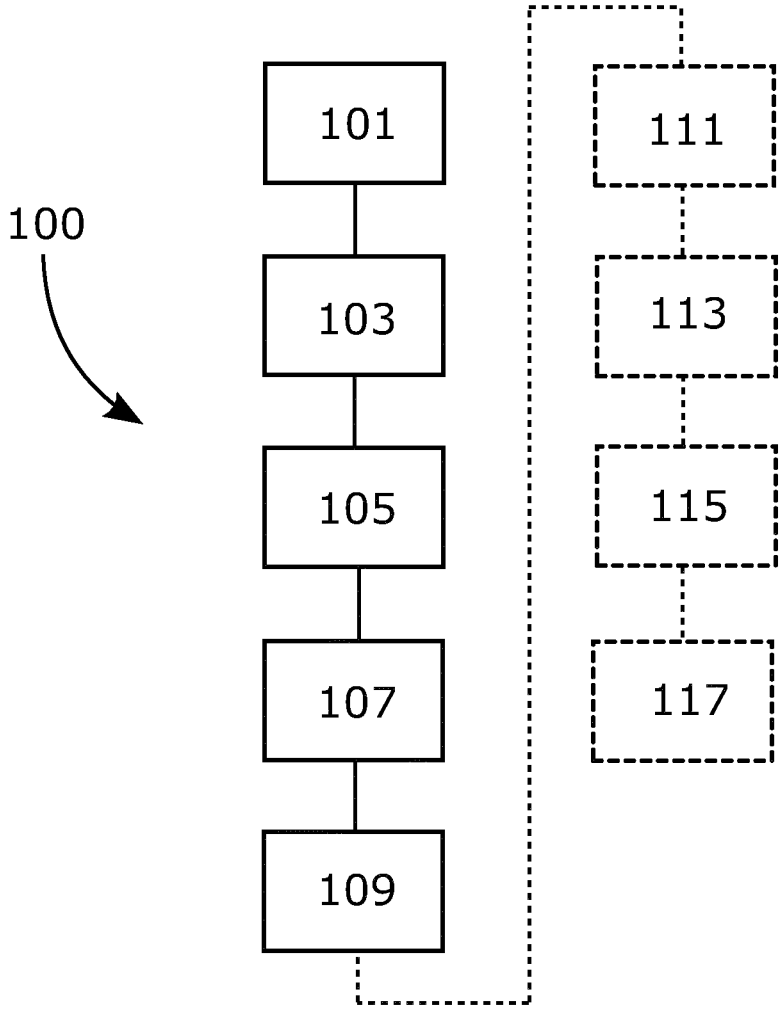
FIG. 1 is a flow chart illustrating a method for controlling operation of a household appliance.
Figure 3:
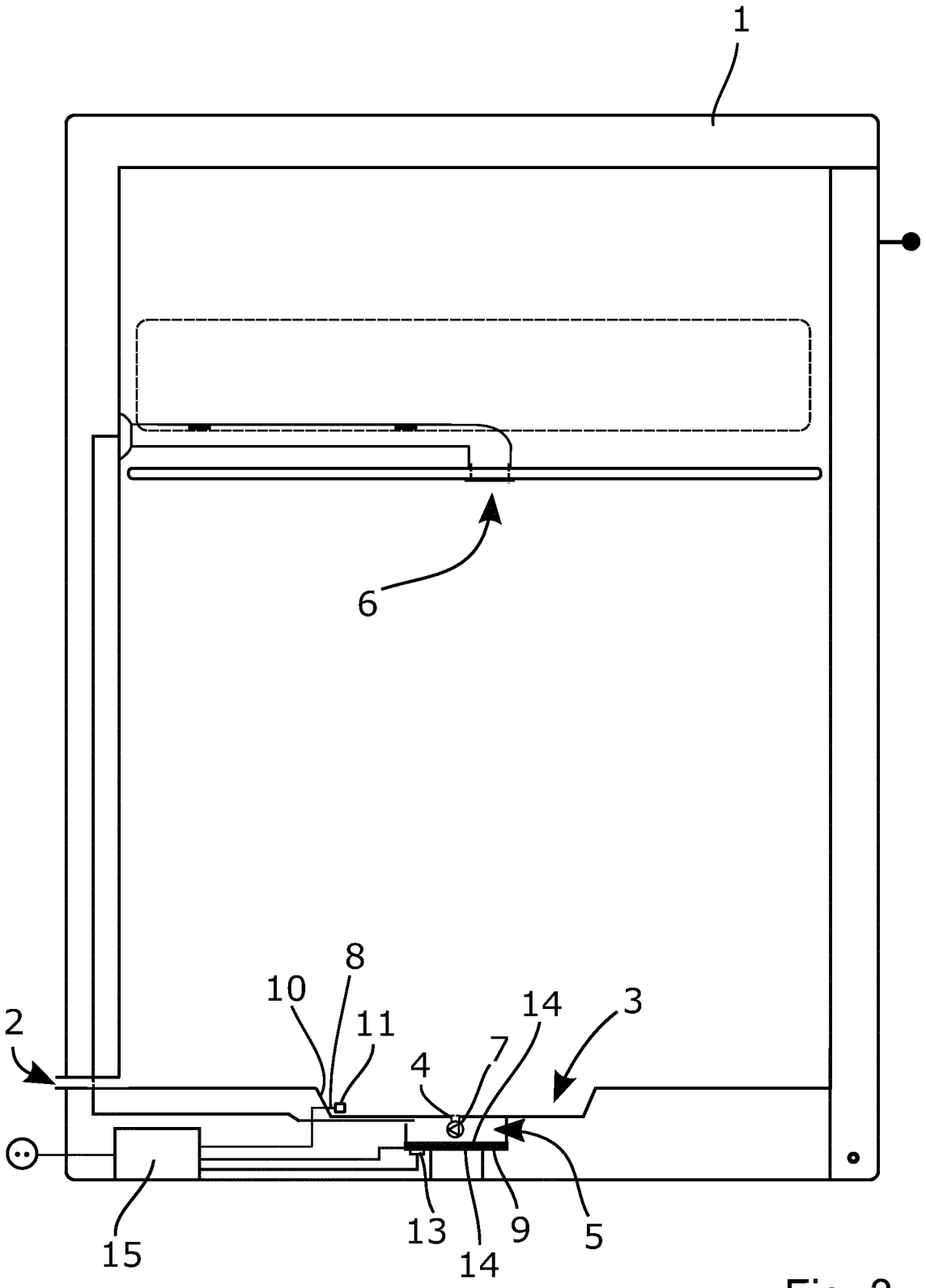

FIG. 1 illustrates an example of actions in a procedure for implementing a method 100 that can be performed for controlling operation of a household appliance, for example a dishwasher, comprising a first space, a second space, a pump arranged to transport a liquid from the first space to the second space, a heating element arranged to heat the liquid in the second space, a first temperature sensor arranged within the first space and a second temperature sensor arranged at the heating element. The method 100 may for example be carried by a control unit connected to or arranged at the household appliance. Such a control unit is shown in FIG. 3 and its function will be described in details in conjunction to description of FIG. 3. In conjunction to the FIG. 3 also other details of the household appliance and theirs function for the method will be described.

The method 100 comprises: supplying 101 the liquid to the first space, determining 103 a first behavior of temperature measured by the first temperature sensor 11 during supplying 101 of the liquid to the first space. The first behavior is described in details in conjunction to FIG. 2*a*. Further, the method 100 comprises supplying 105 the liquid to the second space by activating the pump in order to transport the liquid from the first space to the second space and determining 107 a second behavior of temperature measured by the second temperature sensor during supplying 105 of the liquid to the second space. The second behavior is described in details in conjunction to FIG. 2*b*. The method 100 comprises also determining 109 if a sufficient amount of the liquid has been supplied to the second space or not based on the second behavior evaluated with respect to the first behavior TB1.

The liquid may for example be water or water comprising a detergent.

The first space, which for example may be a sump in a dishwasher (illustrated in FIG. 3), may for example be field with air before the liquid has been supplied to the first space. Thus, the first temperature sensor measures air temperature before the liquid is supplied to the first space. In this situation the air temperature measured by the first temperature sensor will corresponds to an ambient temperature of a room the household appliance is placed in. During supplying of the liquid to the first space first temperature sensor will register changes in temperature because of a temperature difference between the air in the first space and a temperature of the liquid supplied to the first space.

In case of a dishwasher, the liquid may be supplied by a pipe connected to a pipe network and to the dishwasher. The temperature in the first space and in the second space may also vary depending on ambient temperature.

Figure 2A:
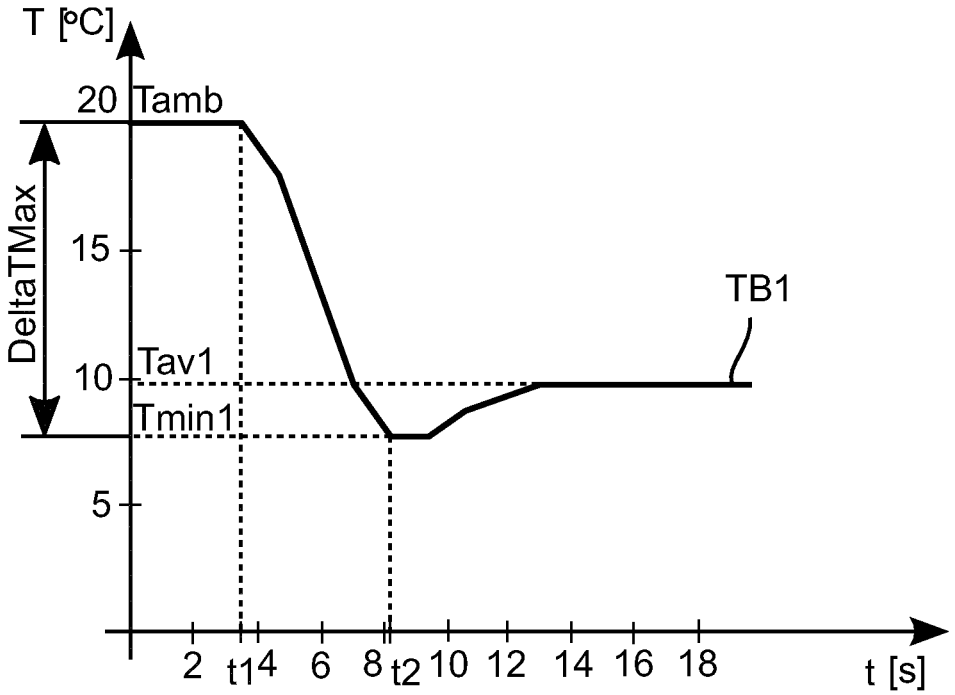
FIG. 2*a* is a diagram illustrating a first behavior of temperature measured by a first temperature sensor during supplying of a liquid to a first space.

Thus, when supplying the liquid to the first space, the first temperature sensor may for example register a temperature drop, with other words the first behavior will then illustrate a temperature decrease if the temperature of the air in the first space is higher than the temperature of the liquid. This example is illustrated in FIG. 2*a*.

After the liquid has been supplied to the first space the temperature measured by the first temperature sensor will achieve a first average temperature which is an average temperature with a value between the liquid temperature and the ambient temperature.

The second space, that may also be called a heating space, may also be filled with air at the ambient temperature before the liquid is supplied to the second space from the first space.

Figure 2B:
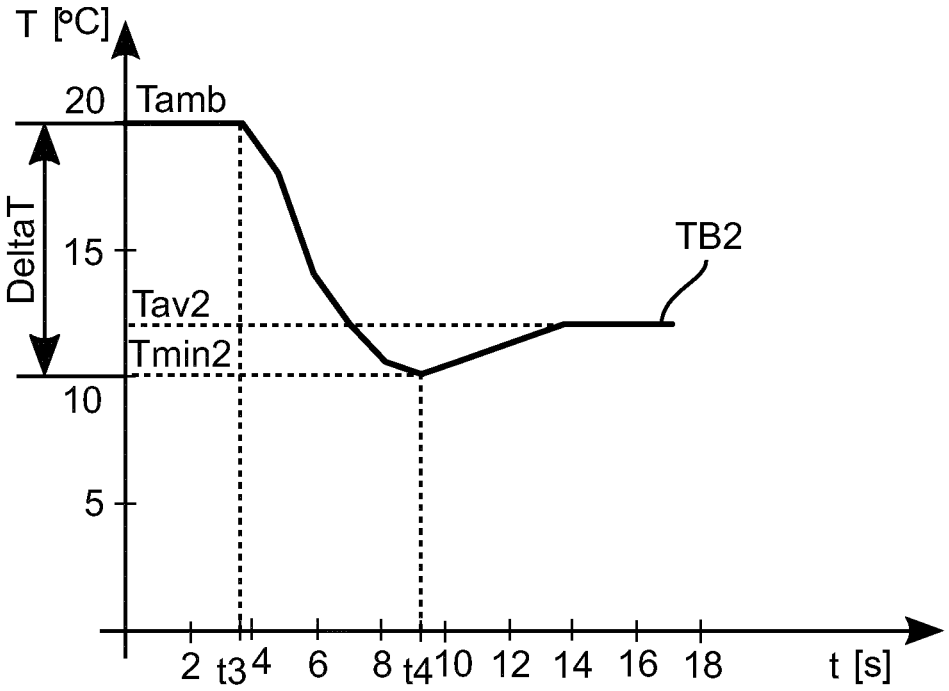
FIG. 2*b* is a diagram illustrating a second behavior of temperature measured by a second temperature sensor during supplying of a liquid to a second space and FIG. 3 is a plane view of a household appliance.

Thus, when supplying the liquid to the second space, the second temperature sensor may also register a temperature drop if the temperature of the air in the second space is higher than the first average temperature of the liquid supplied from the first space. With other words the second behavior will then also illustrate a temperature decrease. This example is illustrated in FIG. 2*b*.

Therefore, by comparing the second behavior with the first behavior it may be determined if a sufficient amount of the liquid has been supplied to the second space or not. Further, function of the pump may be diagnosed, i.e. it may be determined if the pump works properly or not. Thereby, an improved method for controlling operation of a household appliance is achieved.

According to some embodiments the method 100 may comprise: determining 111 a maximum change in temperature during supplying 101 of the liquid to the first space by evaluating the first behavior, determining 113 a change in temperature during supplying 105 of the liquid to the second space by evaluating of the second behavior, wherein the determining 109 if the sufficient amount of the liquid has been supplied to the second space 3 or not is based on a comparison of the change in temperature and the maximum change in temperature.

As an alternative, the method 100 may comprise indicating 115 that the sufficient amount of the liquid has been supplied to the second space if the change in temperature is at least a half of the maximum change in temperature. And further, the method 100 may comprise: indicating 117 that the sufficient amount of the liquid has not been supplied to the second space if the change in temperature is less than a half of the maximum change in temperature.

FIG. 2*a* is a diagram illustrating a first behavior TB1 of temperature T measured by a first temperature sensor during supplying of a liquid to a first space.

According to FIG. 2*a* the temperature T decreases from an ambient temperature Tamb initially measured by the first temperature sensor in the first space. Initially means before the liquid starts to be supplied to the first space. The liquid starts to be supplied to the first space at a first point in time t1. At the first point in time t1 the temperature T starts to decrease because temperature of the liquid is lower than the ambient temperature Tamb. At a second point in time t2 supplying procedure of the liquid to the first space is finished. At the second point in time t2 the temperature T reaches a first minimum value Tmin1. Thus a maximum change in temperature DeltaTMax may be calculated as a difference between the ambient temperature Tamb and the first minimum value Tmin1.

After the liquid has been supplied to the first space i.e. after the procedure of supplying of the liquid to the first space has been finished the temperature T increases and stabilizes on a first average temperature Tav1.

A first time period calculated between the first point in time p1 and the second point in time t2 may also be determined from the first behavior TB1, i.e. by analysing the first behavior TB1.

FIG. 2*b* is a diagram illustrating a second behavior TB2 of temperature T measured by a second temperature sensor during supplying of the liquid from the first space to a second space. As described above the temperature of the liquid supplied to the first space will achieve a first average temperature Tav1. The first average temperature Tav1 may be higher that the liquid temperature of the liquid supplied to the first space. Thereby, temperature of the liquid supplied to the second space may be higher than temperature of the liquid supplied to the first space. Thus, a slower temperature decrease may be observed during supplying of the liquid to the second space than during supplying of the liquid to the first space.

According to FIG. 2*b* the temperature T decreases from the ambient temperature Tamb initially measured by the second temperature sensor in the second space. In a similar way to situation when supplying the liquid to the first space as described above, initially means before the liquid starts to be supplied to the second space.

The liquid starts to be supplied to the second space at a third point in time t3. At the third point in time t3 the temperature T starts to decrease because temperature of the liquid i.e. the first average temperature Tav1 is lower than the ambient temperature Tamb. At a fourth point in time t4 supplying procedure of the liquid to the second space is finished. At the fourth point in time t4 the temperature T reaches a second minimum value Tmin2. Thus a change in temperature DeltaT may be calculated as a difference between the ambient temperature Tamb and the second minimum value Tmin2. As an alternative, another value of the temperature than the second minimum value Tmin2 may be selected for calculating the change in temperature DeltaT.

After the liquid has been supplied to the second space i.e. after the procedure of supplying of the liquid to the second space has been finished the temperature T increases and stabilizes on a second average temperature Tav2.

A second time period calculated between the third point in time p3 and the fourth point in time t4 may also be determined from the second behavior TB2, i.e. from an analysis of the second behavior TB2.

Thus, by evaluating the second behavior TB2 with respect to the first behavior TB1 it may be determined if a sufficient amount of the liquid has been supplied to the second space 5 or not.

The example illustrated in FIGS. 2*a* and 2*b* visualizes a case when a sufficient amount of the liquid has been supplied to the second space. This may be concluded because the change in temperature DeltaT is at least a half of the maximum change in temperature DeltaTMax.

As an alternative the first time period and the second time period, described above, may be used for determining if a sufficient amount of liquid has been supplied to the second space or not.

Other characteristics, as for example derivate of the first behavior TB1 and the second behavior TB2 may be used for determining if a sufficient amount of liquid has been supplied to the second space or not.

FIG. 3 illustrates an example of a household appliance which may be a dishwasher 1 comprising a first space 3, a second space 5 and a pump 7 arranged to transport a liquid from the first space 3 to the second space 5. The first space 3 may also be called sump of the dishwasher 1 or first cavity and is arranged to receive the liquid supplied to the dishwasher through an inlet 2. The inlet 2 may be connected to a pipe network (not shown) for supplying water. The second space 5 is arranged close to the first space 3 i.e. the second space 5 is arranged at a distance from the first space 3, which distance is as short as possible. This, for limiting possible losses when transporting the liquid from the first apace 3 to the second space 5 by the pump 7 and for decreasing costs.

According to the embodiments shown in FIG. 3, the second space 5 may be arranged below the first space 3, seen when the dishwasher 1 is intended to be used for washing dishes.

The pump 7 is arranged to transport the liquid from the first space 3 to the second space 5. As illustrated in the example in FIG. 3, the pump 7, which may be any suitable pump for pumping liquid, may be arranged within the second space 5 and connected to the first space 3 with a channel 4 comprising a filter (not shown).

The dishwasher comprises a heating element 9 arranged to heat the liquid in the second space 5. The heating element 9 is arranged in the second space 5 so that a transfer of thermal energy between the liquid supplied to the second space 5 and the heating element 9 is possible and sufficient for example for heating the liquid for use in the heating element. In a normal use the liquid is heated by the heating element 9 to about 50-70° C. The heating element 9 may be arranged to have direct contact with the liquid supplied to the second space. The second space 5 may be called heating space or second cavity.

During an operation of the dishwasher water is heated by the heating element 9 and is then pumped to a wash arm arrangement 6 of the dishwasher 1. The heating element 9 is connected to a power grid through a control unit 15. The heating of the heating element 9 is electrical and is achieved in a regular manner, which is therefore not necessary to described in detail.

The control unit 15 is connected to a first temperature sensor 11 and to a second temperature sensor 13. The control unit 15 is arranged to receive information data regarding temperature measured by the first temperature sensor 13 and by the second temperature sensor 15. Further, the control unit 15 is arranged to process the information data from the first- and the second temperature sensor 13, 15.

As illustrated in FIG. 3, the first temperature sensor 11 is arranged within the first space 3. The first temperature sensor 11 may be arranged at any suitable positions within the first space 3. According the embodiments in FIG. 3 the first temperature sensor 11 is arranged at a support member 8 and at a distance from an inner wall 10 defining the first space 3. As an alternative the first temperature sensor 11 may be arranged on the inner wall 10.

The second temperature sensor 13 is arranged at the heating element 9. The second temperature sensor 13 may be arranged at a distance from the heating element 9, which distance enables sufficient measurement of temperature of the heating element 9. As illustrated in FIG. 3 the second temperature sensor 13 may be arranged directly on a surface of the heating element 9. If the heating element 9 is arranged to have contact with the liquid supplied to the second space 5, for example by a first surface 12 the second temperature sensor 13 is arranged on a second surface 14 of the heating element 9, which second surface 14 does not have contact with the liquid supplied to the second space 5. With the second temperature sensor 13 arranged for example on the second surface 14 an efficient and correct measurement of temperature of the heating element 9 may be achieved.

The invention claimed is:

1. A household appliance comprising:

a first space;

a second space;

a pump arranged to transport a liquid from said first space to said second space;

a heating element arranged to heat the liquid in said second space;

a first temperature sensor arranged within said first space;

a second temperature sensor arranged at said heating element; and a control unit that executes programming code to perform the following steps prior to turning on the heating element:

supply the liquid to said first space, determine a first behavior (TB1) of temperature measured by the first temperature sensor, wherein said first behavior (TB1) describes how the temperature changes during supplying of the liquid to said first space, supply the liquid to said second space by activating said pump in order to transport said liquid from said first space to said second space, determine a second behavior (TB2) of temperature measured by said second temperature sensor, wherein said second behavior (TB2) describes how the temperature changes during supplying of the liquid to said second space, and determine when a sufficient amount of the liquid has been supplied to said second space or not based on said second behavior (TB2) evaluated with respect to said first behavior (TB1) to prevent turning on the heating element to heat the liquid in the second space when the sufficient amount of the liquid has not been supplied to said second space.

2. The household appliance according to claim 1, wherein the control unit executes the programming code to further perform the following steps:

determine a maximum change in temperature (DeltaTMax) during supplying of the liquid to said first space by evaluating said first behavior (TB1) and determine a change in temperature (DeltaT) during supplying of the liquid to said second space by evaluating of said second behavior (TB2), wherein said determining if the sufficient amount of the liquid has been supplied to said second space or not is based on a comparison of said change in temperature (DeltaT) and said maximum change in temperature (DeltaTMax).

3. The household appliance according to claim 2, wherein the control unit executes the programming code to further indicate that the sufficient amount of the liquid has been supplied to said second space if said change in temperature (DeltaT) is at least a half of said maximum change in temperature (DeltaTMax).

4. The household appliance according to claim 2, wherein the control unit executes the programming code to further indicate that the sufficient amount of the liquid has not been supplied to said second space if said change in temperature (DeltaT) is less than a half of said maximum change in temperature (DeltaTMax).

5. The household appliance according to claim 1, wherein said sufficient amount of the liquid is required for a safe operation of the household appliance.

6. The household appliance according to claim 1, wherein said second temperature sensor is arranged at a surface of said heating element.

* * * * *